US005728232A

United States Patent [19]

Takahashi

[11] Patent Number: 5,728,232

[45] Date of Patent: Mar. 17, 1998

[54] RAW MATERIAL FOR PERMANENT MAGNETS AND PRODUCTION METHOD OF THE SAME

[76] Inventor: Yasunori Takahashi, 5-20, Todoroki 2-Chome, Setagaya-Ku, Tokyo 158, Japan

[21] Appl. No.: 593,720

[22] Filed: Jan. 29, 1996

[51] Int. Cl.[6] ..... H01F 1/03

[52] U.S. Cl. ..... 148/105; 427/128

[58] Field of Search ..... 148/105; 427/127, 427/128, 132

[56] References Cited

U.S. PATENT DOCUMENTS

| | | | |
|---|---|---|---|
| 5,443,717 | 8/1995 | Takahashi | 148/302 |
| 5,453,137 | 9/1995 | Takahashi | 148/306 |
| 5,569,333 | 10/1996 | Takahashi | 427/127 |
| 5,569,335 | 10/1996 | Takahashi | 148/302 |
| 5,569,336 | 10/1996 | Takahashi | 148/302 |

*Primary Examiner*—John Sheehan

*Attorney, Agent, or Firm*—Cushman Darby & Cushman IP Group of Pillsbury Madison & Sutro LLP

[57] ABSTRACT

A raw material for samarium.iron.boron-permanent magnets superior in magnetic properties is provided together with the production method. The material for the permanent magnets comprises an acicular iron powder being prepared by reducing acicular FeOOH (goethite) crystal with hydrogen and having diffused layer of samarium and boron on the surface. The raw material is produced by mixing acicular iron powder obtained by hydrogen reduction of acicular FeOOH crystal with powder of a samarium.cobalt alloy having a melting point lower than 700° C. and powder of boron or powder of a ferro-boron alloy; heating the mixed powder under a hydrogen-nitrogen atmosphere at a temperature between the melting point of the samarium.cobalt alloy and 1200° C. to form coated and diffused layer with the samarium and boron on the surface of the acicular iron powder; and pulverizing the product thus obtained.

6 Claims, No Drawings

RAW MATERIAL FOR PERMANENT MAGNETS AND PRODUCTION METHOD OF THE SAME

BACKGROUND OF THE INVENTION

1. Filed of the Invention

The present invention relates to raw material for samarium.iron.boron-permanent magnets superior in magnetic properties and further to production method of the same.

2. Description of the Prior Art

Rare earth element.iron.boron-permanent magnets are highly praised for the superior magnetic properties. Japanese Patent B-61-34242 discloses a magnetically anisotropic sintered permanent magnet composed of Fe-B(2–28 atomic %)-R(rare earth element, 8–30 atomic %), in which Sm is mentioned as an example of rare earth elements. For its production, an alloy containing the above-mentioned components is cast, the cast alloy is pulverized to an alloy powder, and the alloy powder is molded and sintered. However, the method has defects that the pulverization of cast alloy is a costly step, and properties of the product fluctuate between production batches. Japanese Patent B-3-72124 discloses a production method of an alloy powder for a rare earth element.iron.boron-permanent magnet containing 8–30 atomic % of R (R is at least one rare earth element including Y), 2–28 atomic % of B and 65–82 atomic % of Fe as the main component. The method comprises steps of reducing the raw material powder containing the rare earth oxide, metal and/or alloy with metallic Ca or $CaH_2$ reducing agent, heating the reduced metal in an inert atmosphere, and removing byproducts by leaching with water. Problems accompanied by the method are that steps for removing byproducts and drying are necessary due to the employment of metallic Ca or $CaH_2$ reducing agent, the obtained alloy powder is so fine as 1–10 μm that the powder is readily oxidized in air and the oxygen-containing powder brings about inferior magnetic properties in the final product, and careful handling of the powder necessitates equipments/steps for measuring, mixing and molding thereof under air-insulated conditions, which cause increase in the production cost. Requirement of a large amount of rare earth element also increases the production cost.

SUMMARY OF THE INVENTION

It is an object of the present invention to provide raw material for samarium.iron.boron-permanent magnets readily obtainable and superior in magnetic properties, and further to provide a method of producing the raw material.

The raw material for samarium.iron.boron-permanent magnets according to the present invention comprises an acicular iron powder being prepared by reducing acicular FeOOH (goethite) crystal with hydrogen and having diffused layer of samarium(Sm) and boron(B) on the surface. The raw material having the layer in which nitride is further formed by diffusion of nitrogen can exhibit further enhanced magnetic properties.

DESCRIPTION OF THE PREFERRED EMBODIMENTS

The method of producing the raw material for samarium.iron.boron-permanent magnets comprises steps of:

mixing acicular iron powder obtained by hydrogen reduction of acicular FeOOH (goethite) crystal with powder of a samarium(Sm).cobalt(Co) alloy having a melting point lower than 700° C. and powder of boron or powder of a ferro-boron alloy and optionally powder of cobalt or a cobalt-iron alloy;

heating the mixed powder under a hydrogen-nitrogen atmosphere at a temperature between the melting point of the Sm.Co alloy and 1200° C. to form coated and diffused layer with the samarium and boron on the surface of the acicular iron powder; and pulverizing the product thus obtained; or steps of:

mixing acicular FeOOH (goethite) crystal with powder of a samarium(Sm).cobalt(Co) alloy having a melting point lower than 700° C. and powder of boron or powder of a ferro-boron alloy and optionally powder of cobalt or a cobalt-iron alloy;

heating the mixed powder under a hydrogen-nitrogen atmosphere at a temperature between 300° C. and the melting point of the Sm.Co alloy to reduce the acicular FeOOH crystal to acicular iron powder;

heating successively the resulted powder at a temperature between the melting point of the Sm.Co alloy and 1200° C. to form coated and diffused layer with the samarium and boron on the surface of the acicular iron powder; and pulverizing the product thus obtained.

Thus, in the former method, acicular FeOOH crystal is firstly changed to acicular iron powder by hydrogen reduction, then the acicular iron powder is mixed with raw materials of samarium and boron, the mixed powder is heated to have diffused layer of Sm and B on the surface of the acicular iron powder, while in the latter method, acicular FeOOH crystal, raw materials of samarium and boron are firstly mixed, and successively the FeOOH crystal is changed to acicular iron powder, and then Sm and B are diffused. Since the acicular iron powder obtained by hydrogen reduction of acicular FeOOH crystal tends to react with oxygen in the air to become iron oxide and is highly susceptible of humidity, the latter method is preferred because the steps are operated continuously in a same reactor without being exposed to the air.

Samarium(Sm) is employed as a low melting point alloy with cobalt(Co) having a melting point not higher than 700° C. Despite the melting point of Sm is 1072° C. and that of Co is 1492° C., the melting point of Sm 64 atomic %-Co 36 atomic % alloy is 575° C., and that of Sm 85 atomic %-Co 15 atomic % alloy is 595° C. The lowest melting point is not necessarily required for the alloy, however, a lower melting point enables a lower processing temperature and less requirements for the heating energy.

The size of acicular iron powder is preferably not larger than 10 μm in length, for example, being around 1.0 μm in length and 0.1 μm in width. The acicular iron powder can be produced in a reducing furnace from acicular FeOOH (goethite) crystal having a particle size corresponding to that of the desired acicular iron powder by the reduction with hydrogen at a temperature higher than 300° C. but lower than melting point of the low-melting alloy, preferably at 400°–500° C.

The components preferably contain 0.3–7 atomic % samarium and 1–10 atomic % boron. Components of less than the above content exhibit minor improvements in magnetic properties and a larger content increases the cost without corresponding improvements in magnetic properties. The content of nitrogen is preferably 0–10 atomic %. Cobalt is inevitably contained because a samarium-cobalt alloy is used as the source of samarium, and the content of cobalt may be increased further by adding cobalt powder or cobalt-iron alloy powder. The content of cobalt is preferably 1–15 atomic %. Though the balance of component is for acicular iron powder, inclusion of non-acicular iron of an amount coming from the ferro-boron employed as the boron source is allowable.

The boron powder (melting point 2300° C.) and cobalt powder (melting point 1492° C.) have preferably an average particle size of 1–10 μm. The Sm-Co alloy is not necessarily in a powder form, as it is processed at temperatures above the melting point.

In the present raw material for permanent magnets, since the samarium diffuses only in the surface layer of the acicular iron powder, the amount of the expensive rare earth element necessary for exhibiting superior magnetic properties is smaller than the amount of rare earth elements contained homogeneously in iron for conventional rare earth element.iron.boron-permanent magnets, the present raw material for permanent magnets has beneficial effect on the cost.

In producing the raw material for permanent magnet having diffused nitrogen content, the acicular iron powder having the coated and diffused layer of samarium and boron on the surface of the acicular iron powder is subjected to a heat treatment under pressurized nitrogen. The pressurized nitrogen atmosphere may be kept at temperatures of the same as those for the diffusion of samarium and boron on the surface of iron powder or of under lowering of the temperature. The pressure of nitrogen is preferably not lower than 2 $kg/cm^2$.

The raw material for permanent magnet thus prepared is compression molded, and the resulting compact is sintered in the presence of a magnetic field to obtain a sintered permanent magnet. In the process, the acicular iron powder is oriented vertically under the influence of the magnetic field. Conditions for the compression molding and sintering are the same as those for conventional sintered permanent magnets.

Bond permanent magnets are obtainable by mixing the raw material for permanent magnet with a binder, and subjecting the mixture to hot compression molding in the presence of a magnetic field, by which the acicular iron powder is oriented vertically under the influence of the magnetic field. Conditions for the hot compression molding are the same as those for conventional bond permanent magnets. The binder includes polymeric materials like epoxy resins, polyamide resins, vitrification agents containing MnO, CuO, $Bi_2O_3$, PbO, $Tl_2O_3$, $Sb_2O_3$, $Fe_2O_3$, and combinations thereof.

The present raw material for permanent magnet can be improved in the quality and stabilized against effects of atmospheric oxygen and humidity by forming coating layer of aluminum phosphate on the surface, for which the pulverized raw material is mixed with aluminum phosphate and heated at 300°–500° C. to provide the coating.

The present invention will be explained in detail hereunder, however, the invention never be limited to the following Examples.

[EXAMPLES 1–2]

To acicular FeOOH crystal (goethite; TITAN KOGYO K.K.) was added a Sm.Co alloy (melting point 575° C.; containing 82 wt % (64 atomic %) samarium), boron powder and cobalt powder so as the mixture had the Fe-Co-Sm-B weight ratio mentioned in Table 1 for Example 1 or 2. The mixture was treated in a rotary kiln under ventilation of 5 liter/minute of a gas composed of 10 vol % hydrogen and 90 vol % nitrogen and heating to reach at 460° C. after 2 hours, and was kept at the temperature for 7 hours. During the treatment, the acicular FeOOH crystal was reduced and turned to acicular iron powder (length 0–9 μm, width 0.09 μm). The mixture was further treated under the gas ventilation and raising the temperature to 700° C. in 1 hour, and was kept at the temperature for 7 hours. During the treatment, melted Sm.Co alloy (melting point 575° C.) in combination with the boron powder and cobalt powder adhered on the surface of acicular iron powder and diffused in the surface layer of the acicular iron powder. The material was cooled to room temperature in 5 hours, and the cooled mass was pulverized with a ball mill (with aluminum balls) to obtain a raw material for permanent magnets. The raw material for permanent magnets was subjected to orientation-molding (under 10 KOe magnetic field and 1.5 $t/cm^2$ pressure), sintering in an argon atmosphere for 1 hour at 1000°–1200° C., and cooling to obtain a permanent magnet. The resulting magnet was measured for the coercive force iHc, residual magnetic flux density Br and maximum energy product $(BH)_{max}$, and the result is shown in Table 1.

[EXAMPLE 3]

To acicular FeOOH crystal (goethite; TITAN KOGYO K.K.) was added a Sm.Co alloy (melting point 575° C.; containing 82 wt % (64 atomic %) samarium), boron powder and cobalt powder so as the mixture had the Fe-Co-Sm-B weight ratio mentioned in Table 1 for Example 3. The mixture was treated in a rotary kiln under ventilation of 5 liter/minute of a gas composed of 10 vol % hydrogen and 90 vol % nitrogen and heating to reach at 460° C. after 2 hours, and was kept at the temperature for 7 hours. During the treatment, the acicular FeOOH crystal was reduced and turned to acicular iron powder (length 0.9 μm, width 0.09 μm). The mixture was further treated under the gas ventilation and raising the temperature to 700° C. in 1 hour, and was kept at the temperature for 7 hours. During the treatment, melted Sm.Co alloy (melting point 575° C.) in combination with the boron powder and cobalt powder adhered on the surface of acicular iron powder and diffused in the surface layer of the acicular iron powder. At that stage, the gas ventilation was stopped, and the material was cooled to room temperature during 5 hours with a 5 $kg/cm^2G$ gas composed of 10 vol % hydrogen and 90 vol % nitrogen to obtain a mass having a nitrated surface layer due to diffusion of nitrogen. Composition of the mass is mentioned in Table 1. The mass was pulverized with a ball mill (with aluminum balls) to prepare a raw material for permanent magnets. The raw material for permanent magnets was subjected to orientation-molding (under 10 KOe magnetic field and 1.5 $t/cm^2$ pressure), sintering in an argon atmosphere of 1000°–1200° C. for 1 hour, and cooling to obtain a permanent magnet. The resulting magnet was measured for the coercive force iHc, residual magnetic flux density Br and maximum energy product $(BH)_{max}$, and the result is shown in Table 1.

All the Examples have the coercive force iHc of above 3 KOe being qualified for permanent magnets, and the residual magnetic flux density Br of above 10 KG and maximum energy product $(BH)_{max}$ of above 50 MGOe indicate superiority of the magnet. In place of the composition expressed in parts by weight on Table 1, the composition is further exhibited in atomic % on Table 2 and in weight % on Table 3. All the values of iHc, Br and $(BH)_{max}$ are the average of two samples.

TABLE 1

| | Composition (parts by weight) | | | | | iHc | Br | $(BH)_{max}$ |
|---|---|---|---|---|---|---|---|---|
| | Fe | Co | Sm | B | $N_2$ | (KOe) | (KG) | (MGOe) |
| Example 1 | 95 | 3 | 2 | 1 | — | 10.0 | 14.5 | 54.5 |
| Example 2 | 85 | 13 | 2 | 1 | — | 10.0 | 21.1 | 90.2 |
| Example 3 | 85 | 13 | 2 | 1 | 5 | 10.1 | 27.3 | 141.4 |

TABLE 2

| | Composition (atomic %) | | | | | iHc | Br | $(BH)_{max}$ |
|---|---|---|---|---|---|---|---|---|
| | Fe | Co | Sm | B | $N_2$ | (KOe) | (KG) | (MGOe) |
| Example 1 | 91.6 | 2.7 | 0.7 | 5.0 | — | 10.0 | 14.5 | 54.5 |
| Example 2 | 82.3 | 12.0 | 0.7 | 5.0 | — | 10.0 | 21.1 | 90.2 |
| Example 3 | 75.0 | 10 9 | 0.7 | 4.6 | 8.8 | 10.1 | 27.3 | 141.4 |

TABLE 3

| | Composition (weight %) | | | | | iHc | Br | $(BH)_{max}$ |
|---|---|---|---|---|---|---|---|---|
| | Fe | Co | Sm | B | $N_2$ | (KOe) | (KG) | (MGOe) |
| Example 1 | 94.0 | 3.0 | 2.0 | 1.0 | — | 10.0 | 14.5 | 54.5 |
| Example 2 | 84.1 | 12.9 | 2.0 | 1.0 | — | 10.0 | 21.1 | 90.2 |
| Example 3 | 80.2 | 12.3 | 1.9 | 0.9 | 4.7 | 10.1 | 27.3 | 141.4 |

Increases in the amount of cobalt (Example 2) and the diffusion of nitrogen (Example 3) did not affect the iHc but heightened greatly the Br and $(BH)_{max}$.

A raw material for samarium.iron.boron-permanent magnets superior in magnetic properties is obtainable with ease and less consumption of expensive samarium.

What is claimed is:

1. A method of producing raw material for samarium.iron.boron-permanent magnets, wherein said method comprises the steps of:

mixing acicular iron powder obtained by hydrogen reduction of acicular FeOOH (goethite) crystal with powder of a samarium.cobalt alloy having a melting point lower than 700° C. and powder of boron or powder of a ferro-boron alloy and optionally powder of cobalt or a cobalt-iron alloy;

heating the mixed powder under a hydrogen-nitrogen atmosphere at a temperature between the melting point of the samarium.cobalt alloy and 1200° C. to diffuse samarium and boron in a surface of the acicular iron powder; and pulverizing the product thus obtained.

2. The method of producing raw material for permanent magnets according to claim 1, wherein the raw material comprises 0.3–7 atomic % of samarium and 1–10 atomic % of boron.

3. The method of producing raw material for permanent magnets according to claim 1, wherein the acicular iron powder having the diffused layer of samarium and boron on the surface being further subjected to a heat treatment under pressurized nitrogen atmosphere.

4. A method of producing raw material for samarium.iron.boron-permanent magnets, wherein said method comprises the steps of:

mixing acicular FeOOH (goethite) crystal with powder of a samarium.cobalt alloy having a melting point lower than 700° C. and powder of boron or powder of a ferro-boron alloy and optionally powder of cobalt or a cobalt-iron alloy;

heating the mixed powder under a hydrogen-nitrogen atmosphere at a temperature between 300° C. and the melting point of the samarium.cobalt alloy to reduce the acicular FeOOH crystal to acicular iron powder;

heating successively the resulting powder at a temperature between the melting point of the samarium.cobalt alloy and 1200° C. to diffuse samarium and boron in a surface of the acicular iron powder; and pulverizing the product thus obtained.

5. The method of producing raw material for permanent magnets according to claim 4, wherein the raw material comprises 0.3–7 atomic % of samarium and 1–10 atomic % of boron.

6. The method of producing raw material for permanent magnets according to claim 4, wherein the acicular iron powder having the diffused layer of samarium and boron on the surface being further subjected to a heat treatment under pressurized nitrogen atmosphere.

* * * * *